US005452060A

United States Patent [19]

Sakanobe

[11] Patent Number: 5,452,060

[45] Date of Patent: Sep. 19, 1995

[54] ENDLESS BELT TRANSPORT APPARATUS

[75] Inventor: Makoto Sakanobe, Kanagawa, Japan

[73] Assignee: Fuji Xerox Co., Ltd., Tokyo, Japan

[21] Appl. No.: 12,838

[22] Filed: Feb. 3, 1993

[30] Foreign Application Priority Data

Feb. 4, 1992 [JP] Japan ..... 4-019020

[51] Int. Cl.[6] ..... G03G 5/00

[52] U.S. Cl. ..... 355/212; 355/211; 355/271

[58] Field of Search ..... 355/271, 275, 281, 212, 355/210, 211, 213; 271/7, 10, 264, 198; 38/8, 11; 198/804

[56] References Cited

U.S. PATENT DOCUMENTS

| | | | |
|---|---|---|---|
| 4,204,731 | 5/1980 | Kohler et al. | 355/212 X |
| 4,217,819 | 8/1980 | von Tluck et al. | 355/271 X |
| 4,571,065 | 2/1986 | Yasuda | 355/212 X |
| 4,607,937 | 8/1986 | Minami . | |
| 5,066,974 | 11/1991 | Nakata et al. | 355/71 |
| 5,164,777 | 11/1992 | Agarwal et al. | 355/212 |
| 5,289,235 | 2/1994 | Sakanobe et al. | 355/212 X |

FOREIGN PATENT DOCUMENTS

| | | |
|---|---|---|
| 57-197065 | 12/1982 | Japan . |
| 59-199358 | 11/1983 | Japan . |
| 59-107373 | 6/1984 | Japan . |
| 60-102677 | 6/1985 | Japan . |
| 60-104987 | 6/1985 | Japan . |
| 60-140378 | 7/1985 | Japan . |
| 62-43686 | 2/1987 | Japan . |
| 64-82086 | 3/1989 | Japan . |
| 2180795 | 4/1987 | United Kingdom . |

OTHER PUBLICATIONS

Japanese Abstract, vol. 8, No. 48 (P-258)[1485] Mar. 3, 1984.

*Primary Examiner*—A. T. Grimley
*Assistant Examiner*—Sandra L. Brasé
*Attorney, Agent, or Firm*—Finnegan, Henderson, Farabow, Garrett & Dunner

[57] ABSTRACT

An endless belt transporting apparatus in a transfer unit or an image carrying member in an image forming apparatus, providing a flatness correcting member, mounted between support frames, for obtaining a flatness of the endless belt, and stepped portions formed at both side edge of the flatness correcting member. A pressing member for pressing deformed end portions of the belt may be disposed in opposition to the flatness correcting member.

15 Claims, 7 Drawing Sheets

ENDLESS BELT TRANSPORT APPARATUS

BACKGROUND OF THE INVENTION

The present invention relates to an endless belt transporting apparatus applied for an image carrying member or a transfer unit in an image forming apparatus, such as a copying machine or a printer.

With an image forming apparatus, such as a xerography machine, a photo receptor belt is employed as an image carrying member, a latent electrostatic image formed on the belt is developed with toner, and the developed toner image is transferred onto a paper placed on a transfer belt.

To prevent image quality of the developed image from deteriorating, it is very important to obtain a necessary flatness of the photo receptor belt and the transfer belt in the charging, exposure, developing, and image transferring stages. Generally, with a conventional endless belt transporting apparatus, while the necessary flatness is obtained by supporting endless belts of the photo receptor and transfer belts by means of a plurality of rolls or bars provided in the apparatus, an irregular motion of the endless belts are also suppressed by tensioning the belts. Further, to obtain the flatness, a planar or convex member is disposed so as to entirely contact a reverse surface of the belt.

However, side edge portions 1*a* of the endless belt 1 tend to curl in free state, as shown in FIG. 14. Further, when the endless belt 1 is supported on a flatness correcting member 3 provided between support frames 2 and formed of a roll or bar, the curled side edge portions 1*a* are deformed into minute bulges 4 which extend into a flatness area of the belt. Therefore, problems of deteriorating image quality are caused.

The requirement for obtaining the flatness of the endless belt is more important in the case when the endless belt is an image carrying member, and slit-like latent electrostatic images are formed over a latent electrostatic image already formed on the image carrying member by a pattern exposure unit, so that a tone reproduction performance of a photograph image is improved.

SUMMARY OF THE INVENTION

The present invention has been made in view of the above circumstances and has an object to provide an endless belt transporting apparatus which can restrain an unevenness of an endless belt within a flatness area (an image area if a photo receptor belt is employed, and a paper adsorbing area if a transfer belt is employed), produced by deformed side edge portions of the endless belt, thereby to prevent image quality from deteriorating.

To achieve the above object, there is provided an endless belt transporting apparatus for a transfer unit or an image carrying member in an image forming apparatus, characterized in that the endless belt transporting apparatus is provided with a flatness correcting member mounted between support frames for obtaining a flatness of the belt, and stepped portions formed at both ends of the flatness correcting member, in which the deformed side edge portions of the belt descend to the stepped portions. Pressing members for pressing the deformed side edge portions of the belt may be disposed in opposition to the flatness correcting member.

With the endless belt transporting apparatus thus constructed, since the deformed side edge portions of the endless belt descend to the stepped portions of the flatness correcting member, the unevenness of the flatness within the flatness area can be restrained even if the side edge portions of the belt are deformed. In case the side edge portions of the belt are upwardly deformed, the pressing members press down the deformed side edge portions, necessary flatness of the endless belt is still achieved.

BRIEF DESCRIPTION OF THE DRAWINGS

In the accompanying drawings.

DETAILED DESCRIPTION OF THE PREFERRED EMBODIMENTS

The preferred embodiments of the present invention will be described with reference to the accompanying drawings.

Figure 1:
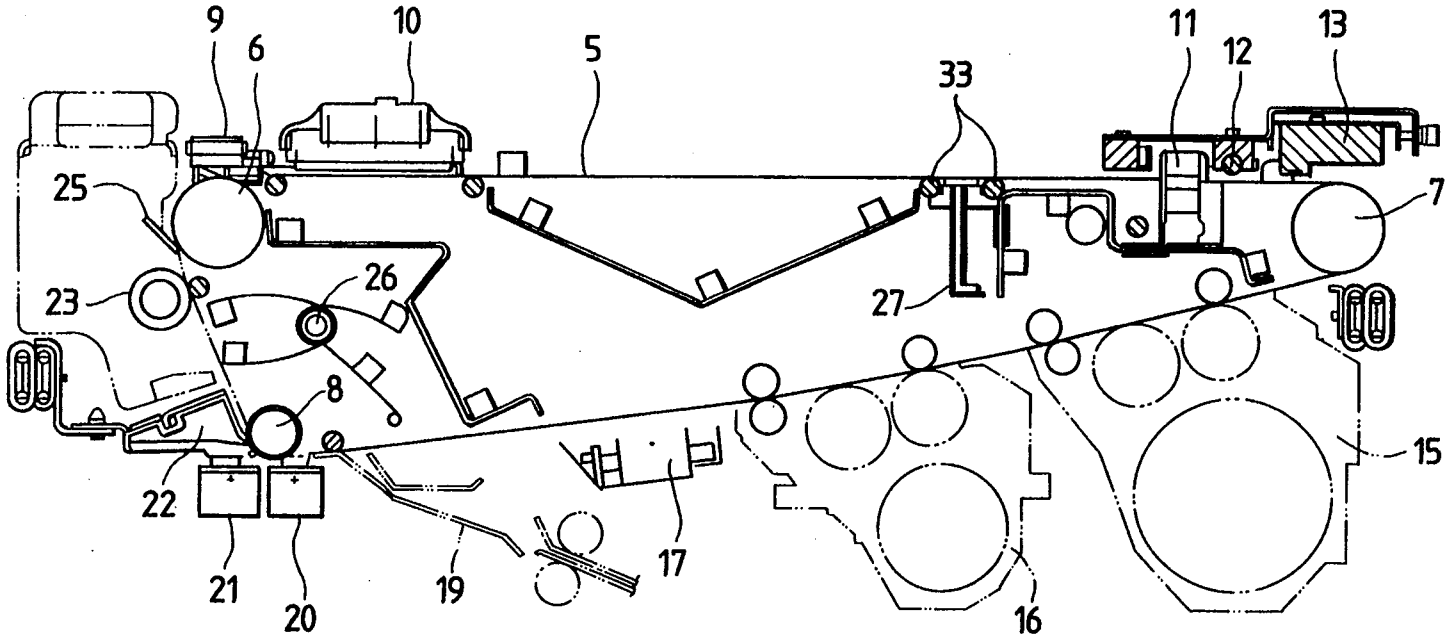
FIG. 1 is a longitudinal sectional view showing an embodiment of an endless belt transporting apparatus according to the present invention.

FIG. 1 is a longitudinal sectional view showing an embodiment of an endless belt transporting apparatus according to the present invention. In the present embodiment, a photo receptor belt as an image carrying member will be used by way of example. The present invention may be applied to a transfer belt.

A photo receptor belt 5 consisting of a transparent endless belt is wound around a drive roller 6, and follower rollers 7 and 8. Disposed along the photo receptor belt 5 are a charge remover 9, a charger 10, a belt timing sensor 11, a photo receptor potential sensor 12, an unnecessary image removal lamp 13, a black developing unit 15, a red developing unit 16, a before-transfer corotron 17, a paper feed unit 19, a transfer corotron 20, a peel-off corotron 21, a paper peel-off finger 22, a cleaning brush 23, and a cleaning blade 25 in clockwise succession. Within the loop of the photo receptor belt 5, as shown, many rolls and bars are disposed in contact with inner surface of the photo receptor belt 5, thereby to obtain a necessary flatness of the belt. Further, a discharge lamp 26 and a pattern exposure unit 27 are disposed within the loop of the photo receptor belt 5.

Figure 2:
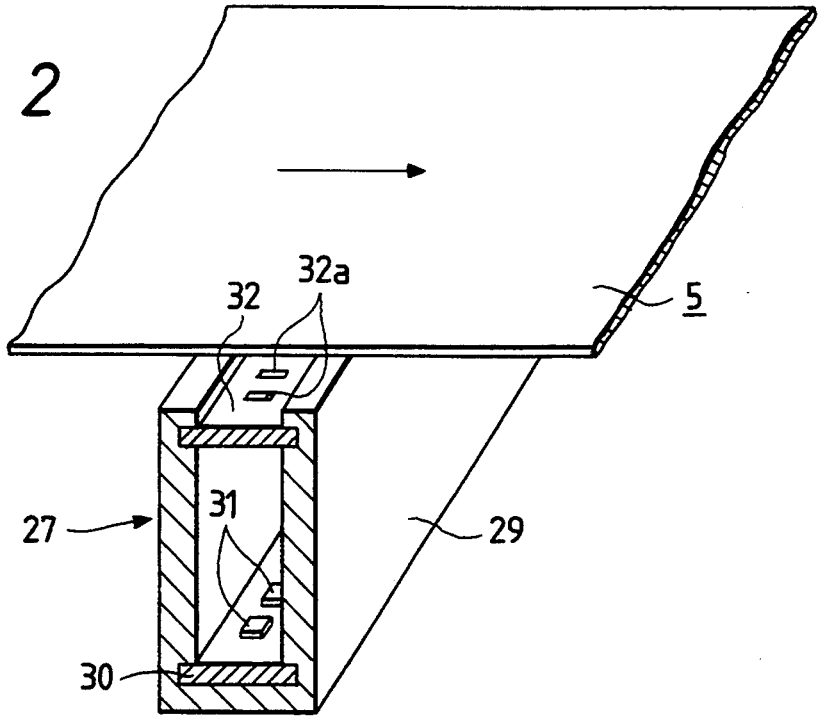
FIG. 2 is a partially broken away perspective view showing a pattern exposure unit used in the endless belt transporting apparatus of FIG. 1.

The pattern exposure unit 27, as shown in FIG. 2, is composed of a case 29 U-shaped in cross section, a substrate 30 mounted on the bottom of the case 29, a plurality of LEDs 31 equidistantly disposed on a surface of the substrate 30, and a pattern plate 32 mounted in an opening portion of the case 29. The LEDs 31, each having a square, light emitting surface of 275 $\mu m \times 275$ $\mu m$, are arrayed at intervals of 4 mm. The pattern plate 32 consists of a plate member of 0.1 mm thick forming a plurality of slits 32*a*, each 0.1 mm wide, arrayed at intervals of 0.1 mm.

With the image forming apparatus thus constructed, the photo receptor belt 5 after being uniformly charged by the charger 10 is transferred to an exposure unit, not shown, and exposed with a light pattern corresponding to an image of an original document. As a result, a latent electrostatic image is formed on the surface of the photo receptor belt 5. Then, a plurality of slit-like latent electrostatic images are formed over the first latent image by the pattern exposure unit 27. The formation of the slit-like latent images over the document latent image increases tone reproduction of a reproduced photographic image. The resultant latent image is developed in the black developing unit 15 and red developing unit 16 with toners which are charged in the opposite polarity from the charge polarity of the latent electrostatic image, and is transported to the transfer corotron 20. At this time, a paper sheet is transported to the transfer corotron 20 synchronously with a movement of the photo receptor belt 5, while being electrostatically attracted to the surface of the photo receptor belt 5 by the operation of the transfer corotron 20. As a result, the toner image is transferred to the paper sheet. Further, the paper having the toner transferred image is transported to a fusing unit, not shown. The paper having the toner image fuzed in the fusing unit is discharged out of the image forming apparatus. Moreover, any residual toner on the surface of the photo receptor belt 5 is removed with the cleaning brush 23 and the cleaning blade 25. Then, the photo receptor belt 5 is discharged by the discharge lamp 26 and is prepared for the next copying process.

With the pattern exposure unit 27, it is essential to keep a predetermined positional relationship with the photo receptor belt 5 in order to obtain a fine tone reproduction. To this end, the embodiment of the endless belt transporting apparatus according to the present invention provides both flatness correcting members 33 formed with rolls, bars or the like, located before and behind the pattern exposure unit 27 as shown in FIG. 1.

Figure 3:
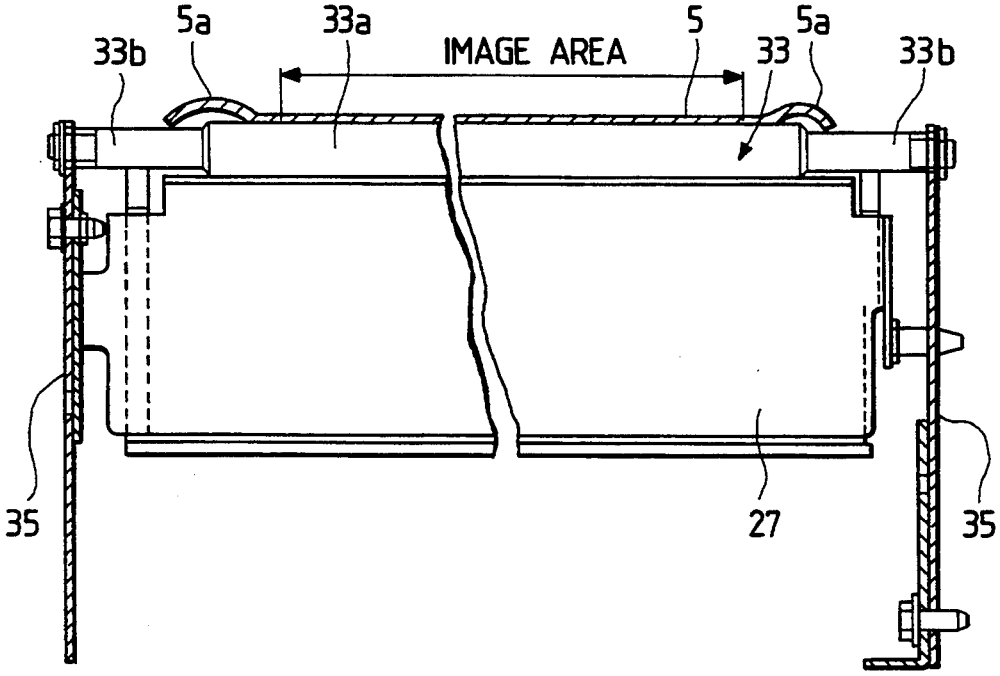
FIG. 3 is a cross sectional view showing a first embodiment of a flatness correcting member used in the endless belt transporting apparatus of FIG. 1.

FIG. 3 is a cross sectional view showing a first embodiment of the flatness correcting member 33 as shown in the FIG. 1. The pattern exposure unit 27 and the flatness correcting member 33 are disposed between a pair of support frames 35. Each flatness correcting member 33 forms a large diameter portion (that is, flat portion) 33*a* contacting the photoreceptor belt 5 over an image area, and small diameter end portions (that is, stepped portions) 33*b* contacting side edge portions 5*a* of the belt. When the side edge portions 5*a* of the photo receptor belt 5 are curled, the side edge portions 5*a* descend to the small diameter portions 33*b* of the flatness correcting member 33. Therefore, an unevenness of the side edge portions 5*a* can be prevented within the image area.

Figure 4:
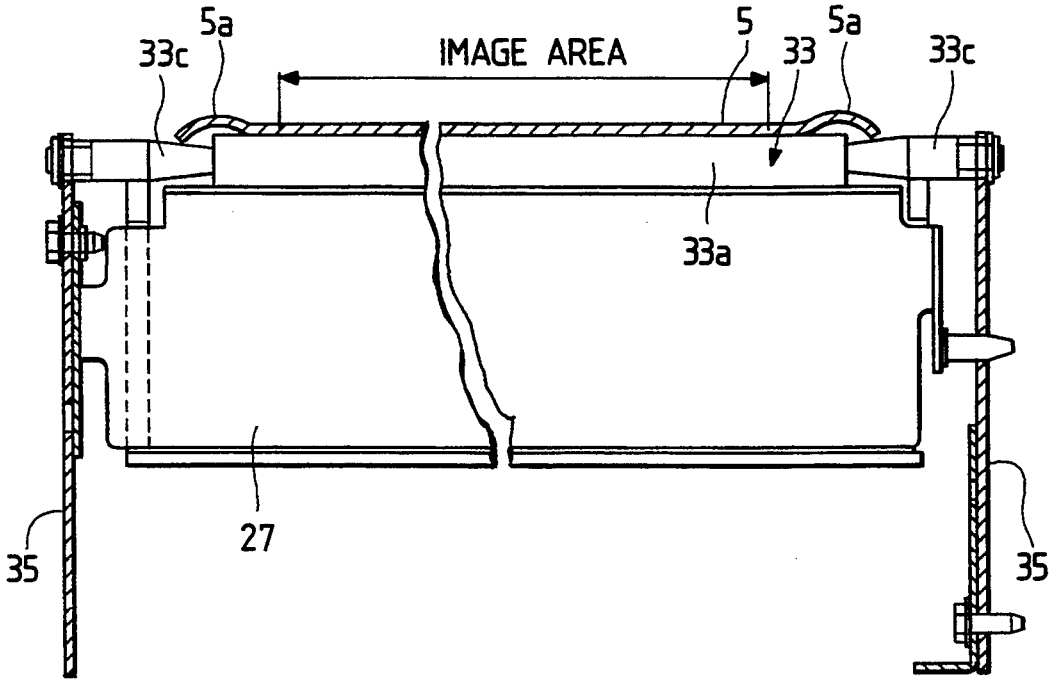
FIG. 4 is a cross sectional view showing a second embodiment of the flatness correcting member used in the endless belt transporting apparatus of FIG. 1.
Figure 5:
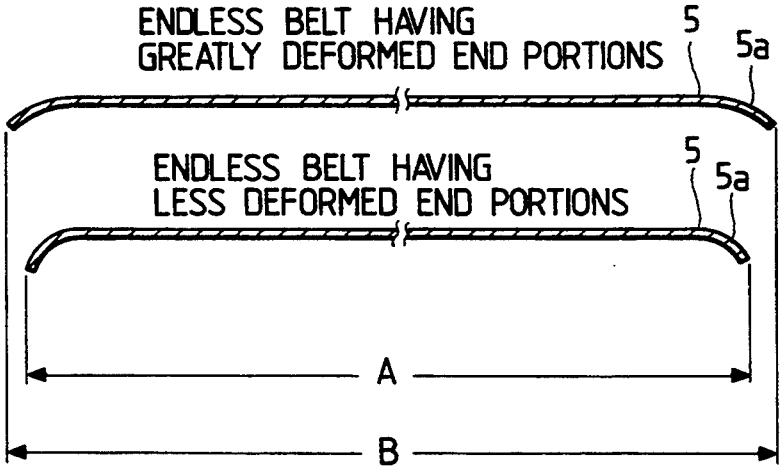
FIG. 5 is a diagram illustrating two types of the endless belt, one being greatly deformed at both side edge portions and the other being less deformed thereat.

A second embodiment of the flatness correcting member 33 shown in FIG. 3 is illustrated in FIG. 4. Like parts and components are denoted by the same reference numerals as those of the flatness correcting member shown in FIG. 3. The second flatness correcting member 33 forms a large diameter portion (that is, flat portion) 33*a* contacting the photo receptor belt within an image area, and tapered end portions (stepped portions) 33*c* contacting side edge portions 5*a* of the belt, wherein the each tapered portion 33*c* is tapered toward the large diameter portion (flat portion) 33*a*. The whole width A of the greatly deformed side edge portion 5*a* of the photo receptor belt 5 is shorter than the whole width B between less deformed side edge portion 5*a*, as shown in FIG. 5. According to the second embodiment, when the side edge portions 5*a* of the belt 5 are greatly deformed, the side edge portions descend to thinner portions of the tapered portions, and when those portions are less deformed, then descend to comparatively thicker portions thereof. Therefore, even if the deformation of the side edge portions 5*a* of the belt 5 varies during the apparatus operating, the varying unevenness of the flatness of the belt can be restrained within the image area.

Figure 6:
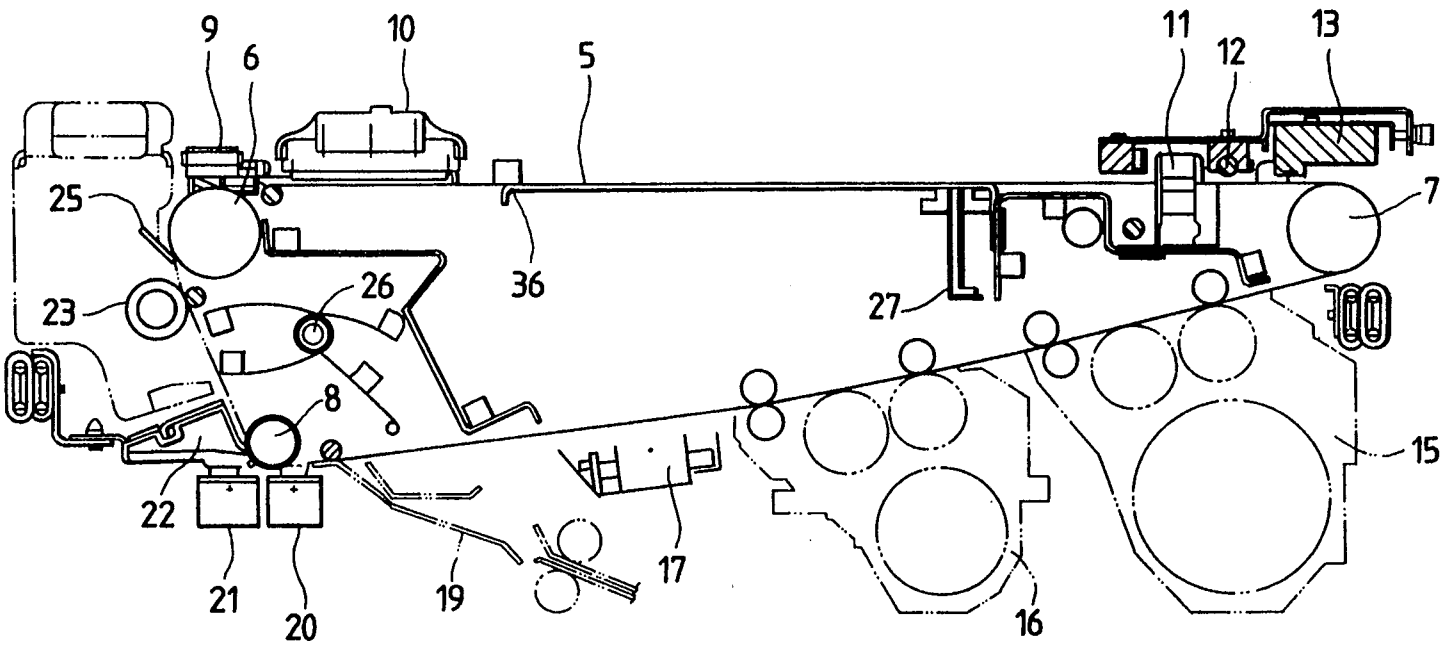
FIG. 6 is a longitudinal sectional view showing another embodiment of the endless belt transporting apparatus according to the present invention.

Another embodiment of the endless belt transporting apparatus according to the present invention will be descried with reference to FIG. 6. Like parts and components are denoted by the same reference numerals as those of the endless belt transporting apparatus shown in FIG. 1. Although the flatness correcting member 33 is formed with rolls, bars or the like, located before and behind the pattern exposure unit 27 in the embodiment as shown in FIG. 1, another embodiment of the endless belt transporting apparatus provides a flatness correcting member 36 formed with a planar member over the exposure area and pattern exposure area.

Figure 7:
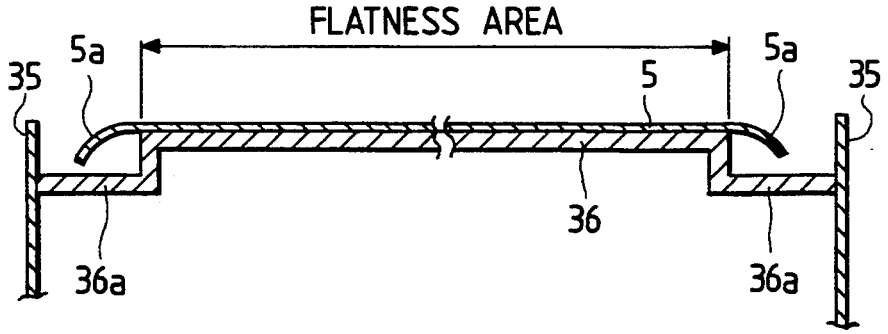
FIG. 7 is a cross sectional view showing a first embodiment of a flatness correcting member used in the endless belt transporting apparatus of FIG. 6.

FIG. 7 is a cross sectional view showing an first embodiment of the flatness correcting member 36 as shown in FIG. 6. The flatness correcting member 36 is mounted between the support frames 35. The flatness correcting member 36 provides a flat portion contacting to the receptor belt 5 within a flatness area, and stepped end portions 36*a* contacting both side edge portions 5*a* of the photo receptor belt 5. With the provision of recessed end portions 33*b*, even if the side edge portions 5*a* of the photo receptor belt 5 are deformed, the side edge portions 5*a* descend to the stepped portions 36*a* of the flatness correcting member 36. Therefore, an unevenness of the flatness of the deformed side edge portions 5*a* can be restrained within the image area.

Figure 8:
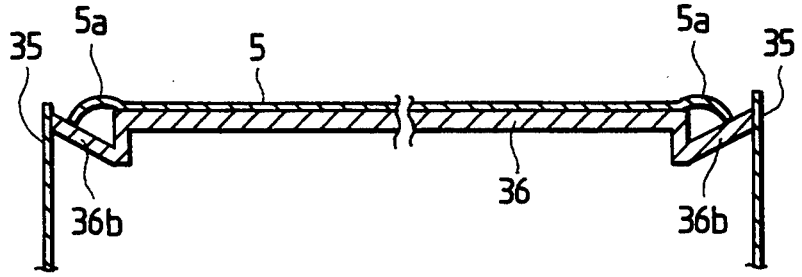
FIG. 8 is a cross sectional view showing a second embodiment of the flatness correcting member used in the endless belt transporting apparatus of FIG. 6.

FIG. 8 is a cross sectional view showing a second embodiment of the flatness correcting member 36 according to the apparatus in FIG. 6. The second embodiment also provides a flat portion contacting the receptor belt 5 within a flatness area, and stepped portions 36*b* at both ends of the flatness correcting member 36 having a similar effect to the tapered portions 36*a* in FIG. 4.

Figure 9:
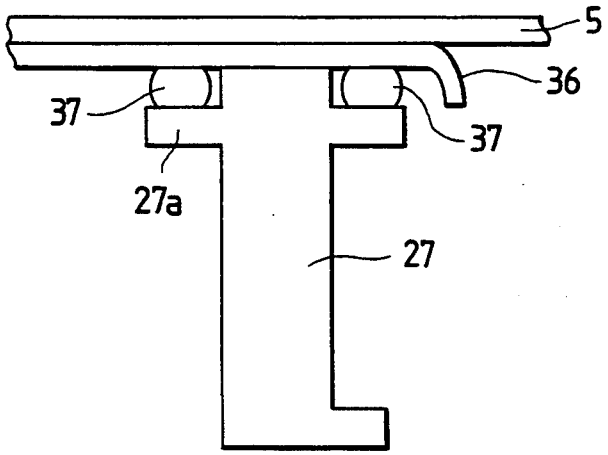
FIG. 9 is a side view of a pattern exposure unit used in the endless belt transporting apparatus of FIG. 6 and structured to mount a flatness correcting member.

FIG. 9 is a side view showing a construction in the vicinity of the pattern exposure unit 27 in FIG. 6. The pattern exposure unit 27 is provided with flanges 27*a* for supporting positioning members 37. The flanges 27*a* contact the flatness correcting member 36 through positioning members 37.

Still other embodiments according to the present invention will be described as follows. Although the embodiments as described above obtain the flatness of the belt by applying the flatness correcting member to a reverse surface of the photo receptor belt in cooperation with a conventional flatness correcting member, still other embodiments according to the present invention obtain the flatness by applying a member to an upper surface of the photo receptor belt.

Figure 10:
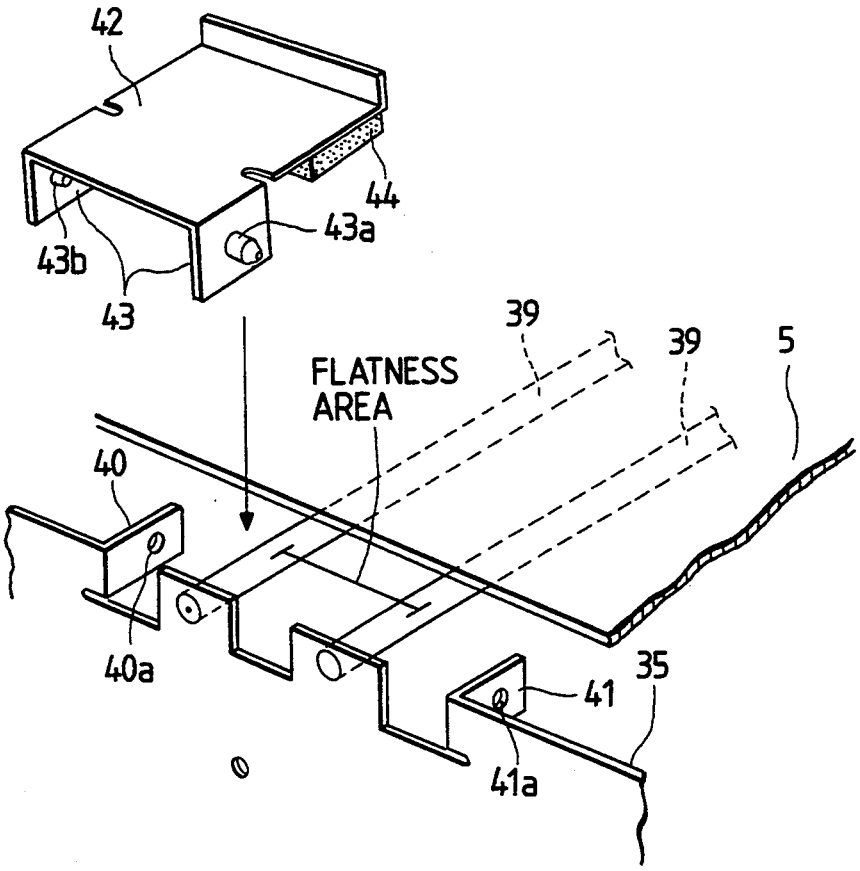
FIG. 10 is an exploded view in perspective showing a first embodiment of a flatness correcting member combined with a pressing member according to the present invention.
Figure 11:
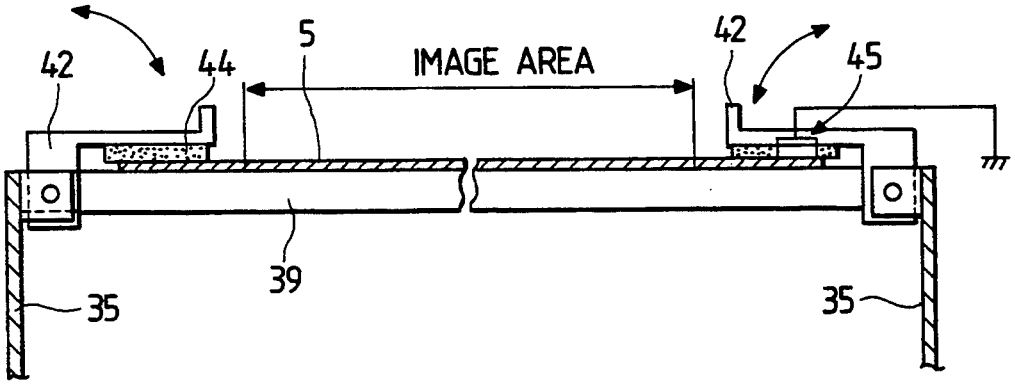
FIG. 11 is a cross sectional view showing a second embodiment of the flatness correcting member combined with the pressing member according to the present invention.

FIG. 10 is an exploded view in perspective showing a first embodiment for obtaining the necessary flatness by contacting the upper surface of the photo receptor belt 5. Both flatness correcting members 39 are mounted by support frames 35, which are located within a flatness area relative to the pattern exposure unit 27. The flatness correcting members 39 may be formed as bars, rolls or a plate. In this embodiment, bent pieces 40 and 41 are provided with the support frame 35, mounting holes 40*a* and 41*a* are formed at the bent pieces 40 and 41, and a pressing member 42 is provided so as to press against a side edge portion of the photo receptor belt 5. The pressing member 42 provides two mounting pieces 43 having a mounting pin 43*a* and a mounting hole 43*b*, respectively, and a resilient member 44 made of a felt or the like and fixed on the lower surface thereof. The pressing member 42 is mounted to the support frame 35 in a manner that the mounting pin 43*a* is inserted into the hole 41*a* of the bent piece 41, and the hole 43*b* of the piece 43 is aligned with the hole 40*a* of the bent piece 40 and those pieces are fastened together by means of a suitable screw member. When the pressing member 42 is mounted to the support frame 35, the pressing member 42 presses against a side edge portion of the photo receptor belt 5 through the resilient member 44 interposed therebetween. Although only one combination of the support frame 35 and the pressing member 42 is illustrated as shown in FIG. 10, a pair of pressing members are actually provided with the support frames, as shown in FIG. 11. According to this embodiment, a necessary flatness of the photo receptor belt 5 can be obtained even if the belt side edge portions are curled upwardly.

FIG. 11 is a cross sectional view showing a second embodiment obtaining the flatness by contacting the upper surface of the photo receptor belt. Since each pressing member 42 is rotatable as indicated by arrows in FIG. 11, it is easy to repair the photo receptor belt 5 and to replace it with a new belt. Further, an earthing member 45 is provided on the lower surface of one side of the pressing members 42 so as to contact to the photo receptor belt 5.

Figure 12:
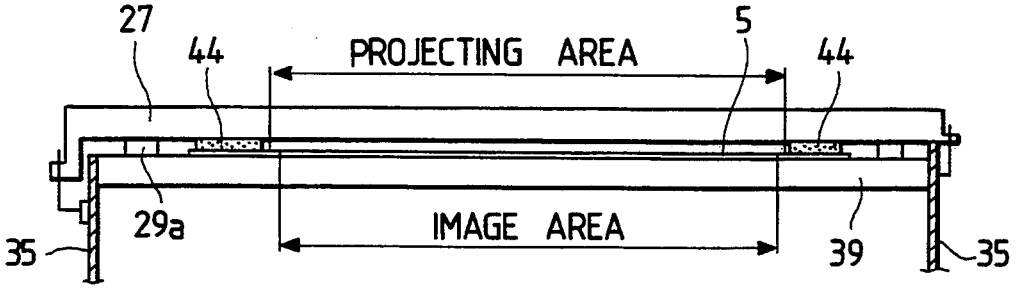
FIG. 12 is a cross sectional view showing a third embodiment of the flatness correcting member combined with the pressing member according to the present invention.
Figure 13:
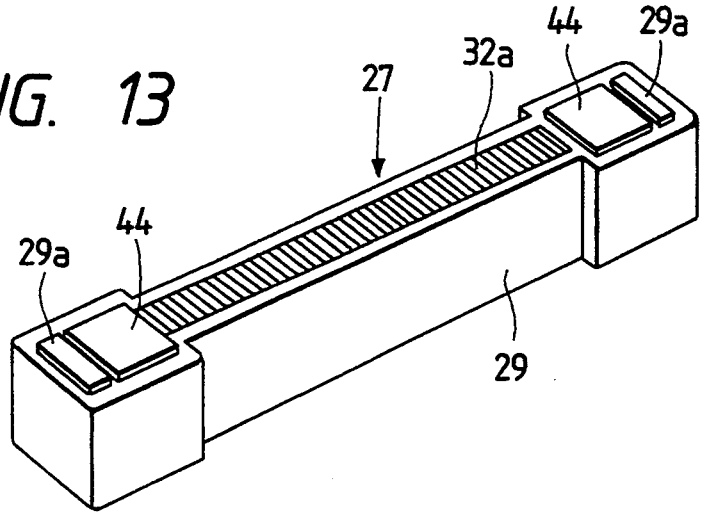
FIG. 13 is a perspective view showing a pattern exposure unit in FIG. 12.
Figure 14:
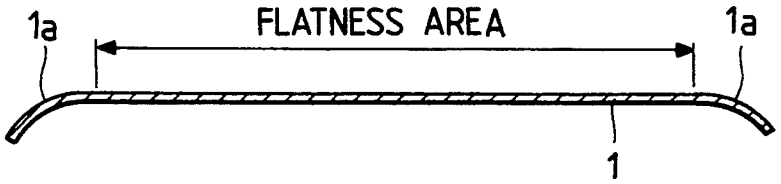
FIG. 14 is a cross sectional view showing an endless belt placed in free state.
Figure 15:
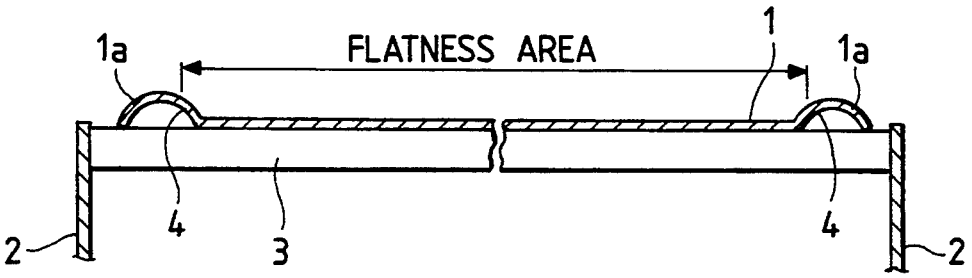
FIG. 15 PRIOR ART
FIG. 15 is a cross sectional view showing a flatness correcting member according to a conventional endless belt transporting apparatus.

FIGS. 12 and 13 show a third embodiment for obtaining flatness by acting on the upper surface of the photo receptor belt. In this embodiment, a pair of positioning members 29*a* and resilient members 44 are provided beyond the ends the slits 32*a* are formed on the case 29 of the pattern exposure unit 27. The case 29 is fixed to the support frames 35 so as to contact the flatness correcting member 39 through the positioning member 29*a* interposed therebetween. Therefore, the resilient members 44 press the side edge portions of the photo receptor belt 5 against flatness correction members 39. According to this embodiment, since the pattern exposure unit 27 projects a slit pattern onto the upper surface of the photo receptor belt 5, a necessary flatness within the image area on the belt can be obtained only by simply fixing the pattern exposure unit 27 to the support frame 35.

As is apparent from the above description, according to the present invention, when the flatness correcting member is applied to an endless belt transporting apparatus, a necessary flatness can be obtained within a flatness area of the belt. Therefore, the present invention can succeed in solving the problem of image quality deterioration due to the uneven surface of a deformed photo receptor belt. With the copying machine, since the endless belt is employed as a photo receptor belt or a transfer belt, the flatness area is referred to as the image area for the photo receptor belt and the paper adsorbing area for the transfer belt.

What is claimed is:

1. An endless belt transporting apparatus comprising:
an endless belt having opposed side edge portions;
a plurality of transporting members for transporting said endless belt in a lengthwise direction; and
at least one flatness correcting member for obtaining a flatness of said endless belt, said flatness correcting member extending transversely to the lengthwise direction and comprising a flat portion and a separate stepped portion contacting each end of said flat portion, wherein said stepped portions contact said side edge portions of said endless belt to allow a portion of said endless belt between said contacted side edge portions to lie flat against said flat portion of said flatness correction member.

2. The endless belt transporting apparatus of claim 1, wherein said flatness correcting member is in the form of a roll.

3. The endless belt transporting apparatus of claim 2, wherein said stepped portions comprise end portions of said roll having a smaller diameter than said flat portion of said roll.

4. The endless belt transporting apparatus of claim 2, wherein said stepped portions comprise tapered portions tapered toward said flat portion of said roll.

5. The endless belt transporting apparatus of claim 1, wherein said flatness correcting member is in the form of a planar member.

6. The endless belt transporting apparatus of claim 5, wherein said stepped portions are recessed relative to said flat portion of said planar member.

7. The endless belt transporting apparatus of claim 6, wherein said stepped portions are downwardly inclined toward said flat portion of said planar member.

8. The endless belt transporting apparatus of claim 1, further comprising a pattern exposure unit located between a pair of said flatness correcting members, said pattern exposure unit forming a plurality of slit-like latent electrostatic images over a latent electrostatic image already formed on said endless belt.

9. An endless belt transporting apparatus comprising:
an endless belt having opposed side edge portions;
a plurality of transporting members for transporting said endless belt in a lengthwise direction;

at least one flatness correcting member for obtaining a flatness of said endless belt;

a pair of support members for supporting said flatness correcting member; and a pair of pressing members disposed in opposition to said flatness correcting member, said pressing members including resilient members arranged transversely of the lengthwise direction and positioned to engage and press said side edge portions of said endless belt against said flatness correcting member.

10. The endless belt transporting apparatus of claim 9, wherein said support members and said pressing members include mounting holes, said pressing members mounted to said support members by inserting pin members and fastening screws through said mounting holes.

11. The endless belt transporting apparatus of claim 10, wherein said pressing members are mounted by said support members for pivotal movement relative to said endless belt.

12. The endless belt transporting apparatus of claim 9, further comprising an earthing member mounted on a lower surface of one of said pressing members so as to contact said endless belt.

13. The endless belt transporting apparatus of claim 9, further comprising a pattern exposure unit for forming a plurality of slit-like latent electrostatic images over a latent electrostatic image already formed on said endless belt.

14. The endless belt transporting apparatus of claim 13, wherein said pattern exposure unit comprises a pair of flanges, said flanges mounting positioning members for contacting said flatness correcting member.

15. An endless belt transporting apparatus comprising:

a photoreceptor in the form of an endless belt having opposed side edge portions;

a plurality of transporting members for transporting said endless belt in a lengthwise direction;

at least one flatness correcting member for obtaining a flatness of said endless belt;

a pair of support members supporting said flatness correcting member in contacting relation with said endless belt; and a pattern exposure unit, connected to said support members, for forming a plurality of slit-like latent electrostatic images over a latent electrostatic image already formed on said endless belt, said pattern exposure unit including a pair of positioning members and resilient members, said pattern exposure unit connected to said support members such that said positioning members contact said flatness correcting member and said resilient members press said side edge portions of said endless belt against said flatness correcting member.

* * * * *